US007744411B2

(12) United States Patent
Casses et al.

(10) Patent No.: US 7,744,411 B2
(45) Date of Patent: Jun. 29, 2010

(54) SEALED ELECTRICAL CONNECTOR PART

(75) Inventors: Claude Casses, Clevilliers (FR); Gérard Mulot, Nogent le Roi (FR); Thierry Colinmaire, Strasbourg (FR); Jean-François Clerc, Paris (FR)

(73) Assignee: FCI, Versailles (FR)

( * ) Notice: Subject to any disclaimer, the term of this patent is extended or adjusted under 35 U.S.C. 154(b) by 544 days.

(21) Appl. No.: 10/586,943

(22) PCT Filed: Feb. 9, 2005

(86) PCT No.: PCT/EP2005/001399

§ 371 (c)(1),
(2), (4) Date: Nov. 1, 2007

(87) PCT Pub. No.: WO2005/088773

PCT Pub. Date: Sep. 22, 2005

(65) Prior Publication Data

US 2008/0280497 A1 Nov. 13, 2008

(30) Foreign Application Priority Data

Feb. 12, 2004 (FR) ..... 04 01409

(51) Int. Cl.
*H01R 13/40* (2006.01)

(52) U.S. Cl. ..... 439/587; 439/275; 439/425

(58) Field of Classification Search ..... 439/587, 439/589, 274, 275, 157
See application file for complete search history.

(56) References Cited

U.S. PATENT DOCUMENTS

| | | | | |
|---|---|---|---|---|
| 3,989,338 | A | 11/1976 | Gosser | 339/96 |
| 4,824,390 | A | 4/1989 | Crane et al. | 439/271 |
| 4,973,268 | A | 11/1990 | Smith et al. | 439/595 |
| 6,196,873 | B1 | 3/2001 | Murakami et al. | 439/595 |
| 6,485,332 | B1 * | 11/2002 | Kwang | 439/587 |
| 6,500,027 | B1 * | 12/2002 | Van Der Sanden et al. | 439/587 |
| 6,638,108 | B2 * | 10/2003 | Tachi | 439/595 |
| 6,739,908 | B2 * | 5/2004 | Hamai et al. | 439/587 |
| 6,767,250 | B2 * | 7/2004 | Casses et al. | 439/587 |
| 6,773,278 | B2 * | 8/2004 | Valasek et al. | 439/157 |
| 7,114,991 | B2 * | 10/2006 | Shiga et al. | 439/587 |

FOREIGN PATENT DOCUMENTS

| | | |
|---|---|---|
| EP | 0 671 789 A1 | 9/1995 |
| EP | 1 296 415 A1 | 3/2003 |

* cited by examiner

*Primary Examiner*—Hien Vu
(74) *Attorney, Agent, or Firm*—Harrington & Smith

(57) ABSTRACT

This connector part includes an insulating housing provided with a plurality of sockets for receiving a contact, which have a rear contact insertion end; a joint, which is provided with a plurality of cable passages corresponding to the sockets and which is placed in said housing behind the sockets; and a cable-guiding grid, which is fixed in the housing behind the joint, supporting the latter, said grid being provided with a plurality of cable passages corresponding to the sockets. It also includes a member for blocking the passages of the grid, which is fixed on said grid and is designed for being pierced selectively for the insertion of contacts into a predetermined group of sockets. The invention also relates to a piercing tool, which is designed for being used with one such connector part, and to a corresponding wiring method.

10 Claims, 7 Drawing Sheets

SEALED ELECTRICAL CONNECTOR PART

BACKGROUND OF THE INVENTION

The present invention relates to an electrical connector part provided for being coupled with a matching connector part by a front face, said connector part comprising

- an insulating housing provided with a plurality of sockets for receiving a contact, which have a rear contact insertion end,
- a joint, which is provided with a plurality of cable passages corresponding to the sockets and which is placed in said housing behind the sockets, and
- a cable-guiding grid, which is fixed in the housing behind the joint, supporting the latter, said grid being provided with a plurality of cable passages corresponding to the sockets.

Such an electrical connector part is described, for example, in the French patent application published under No. 2,830, 132.

In a connector part of this type, referred to as a "partially populated" connector, some of the connection paths may be unused, so that, in order to ensure the sealing of the connector, it is necessary to block the corresponding passages of the joint (also referred to as a "grommet"). To do this, a blocking piece is inserted into each of the unoccupied sockets and afterwards allowed to remain in the connector part. The blocking piece is generally composed of a piece of molded plastic, the outer shape of which reproduces in part the shapes of a contact and of an end section of the cable that it replaces.

The insertion of such blocking pieces represents a relatively significant operating time on the assembly line. If the operation is performed manually, it requires a sustained attention on the part of the operator in order to block all of the unoccupied paths. If the operation is performed automatically, it requires a specific, relatively perfected and costly tooling.

In addition, this operation can be the origin of serious malfunctions of the connector if an unoccupied path is not blocked or is incorrectly blocked.

Also known in the prior art are joints of the grommet type in which is formed a thin membrane that blocks all of the socket passages at the level of a median section of the passages. This membrane is designed to be pierced in the passages receiving a contact as a result of the insertion of the contact itself, whereas the membrane stays intact in the unused passages.

Due to the position of the membrane in the interior of the joint, the state of the membrane is not apparent, so that it is difficult not only to prevent wiring mistakes, but also to detect them.

Such an arrangement additionally poses a substantial problem, which consists of reestablishing the sealing of the joint in the event that a contact is inserted by mistake in a path that is designed to be unused. In fact, if the mistake is discovered, the operator has to withdraw the contact and block the passage, for example, by using a plug, which constitutes an additional tedious operation.

SUMMARY OF THE INVENTION

The object of the invention is to remedy these drawbacks and, in particular, to prevent wiring mistakes.

To this end, the subject of the invention is an electrical connector part of the above-mentioned type, which comprises a member for blocking the passages of the grid, which is fixed on said grid and which is designed to be pierced selectively for inserting contacts into a predetermined group of sockets.

This arrangement possibly affords an additional advantage, which consists in sealing, independently of the sealing imparted or not by the grommet and when a piercing has not yet occurred, all of the passages of the connector part or some of them, without it being necessary to modify the joint or to add plugs.

The electrical connector part in accordance with the invention may comprise, in addition, one or more of the following characteristics:

- said blocking member is a film of plastic material that covers at least partially one face of the grid;
- the film is fastened adhesively or welded to the grid;
- said blocking member is a plate fixed on the grid by spring coupling;
- said blocking member is fixed on the rear face of the grid;
- said blocking member has, on its rear face, marks identifying the sockets; and
- said blocking member is adapted in order to prevent the insertion of a contact into a given passage in the absence of a prior piercing of the blocking member in said given passage by a tool designed for this purpose.

The invention also concerns a tool for piercing the blocking member of a connector part such as described above, this tool comprising a body and a plurality of pins, which project from said body in a parallel manner and in the same direction and which are designed to pierce the blocking member at the points corresponding to a predetermined group of sockets.

The following are other characteristics of the tool in accordance with the invention:

- the pins are tapered at their free end; and
- the body is designed to be inserted at least partially in a form-fitting manner from the rear into the interior of the housing.

Finally, the invention concerns a wiring method of an electrical connector part such as described above. According to this method, the following steps are carried out in succession:

- piercing the blocking member by means of a tool such as described above; and
- introducing into each socket, the access of which has been freed by the piercing operation, a wired contact designed for this purpose.

BRIEF DESCRIPTION OF THE DRAWINGS

One particular embodiment of the invention will now be described in greater detail with reference to the attached drawings, in which.

DETAILED DESCRIPTION OF THE INVENTION

Depicted in the figures is an electrical connector part, here a male connector part, that is designed to be coupled with a complementary part, referred to as a "matching part," here a female part (not depicted).

Typically, the connector part depicted is designed to be coupled with a connection seat of a motor vehicle electronic control unit. However, it is obvious that the invention that is going to be described applies to numerous other types of connectors.

For reasons of clarity, the figures have been oriented along the X axis, which represents the direction of coupling of the two complementary connector parts.

All of the terms indicating a direction or a position are understood to refer to the orientation thus defined. In this way, the connector part depicted in the Figures has a front face corresponding to the coupling face.

Figure 1:
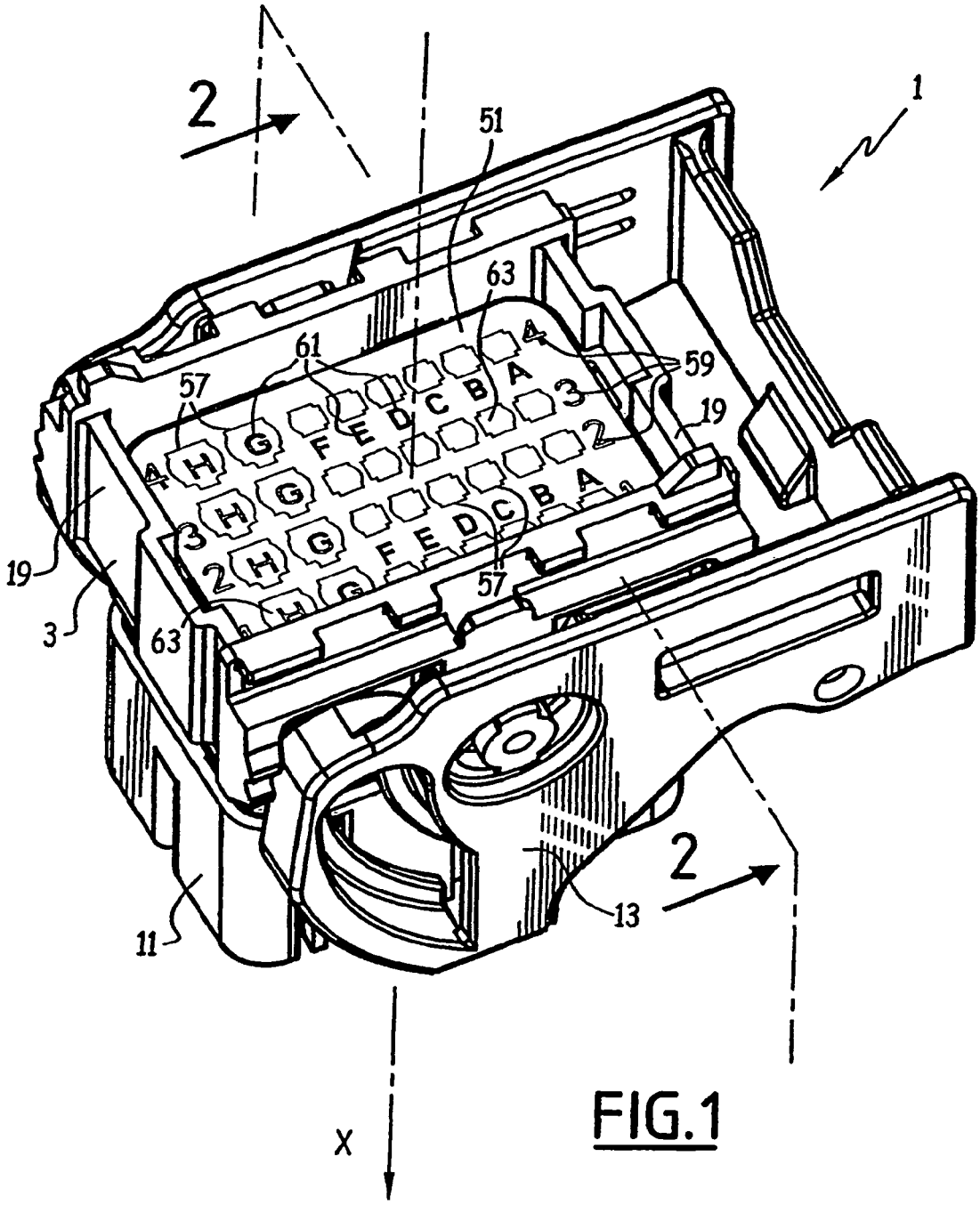
FIG. 1 is a rear perspective view of an electrical connector part in accordance with the invention.
Figure 2:
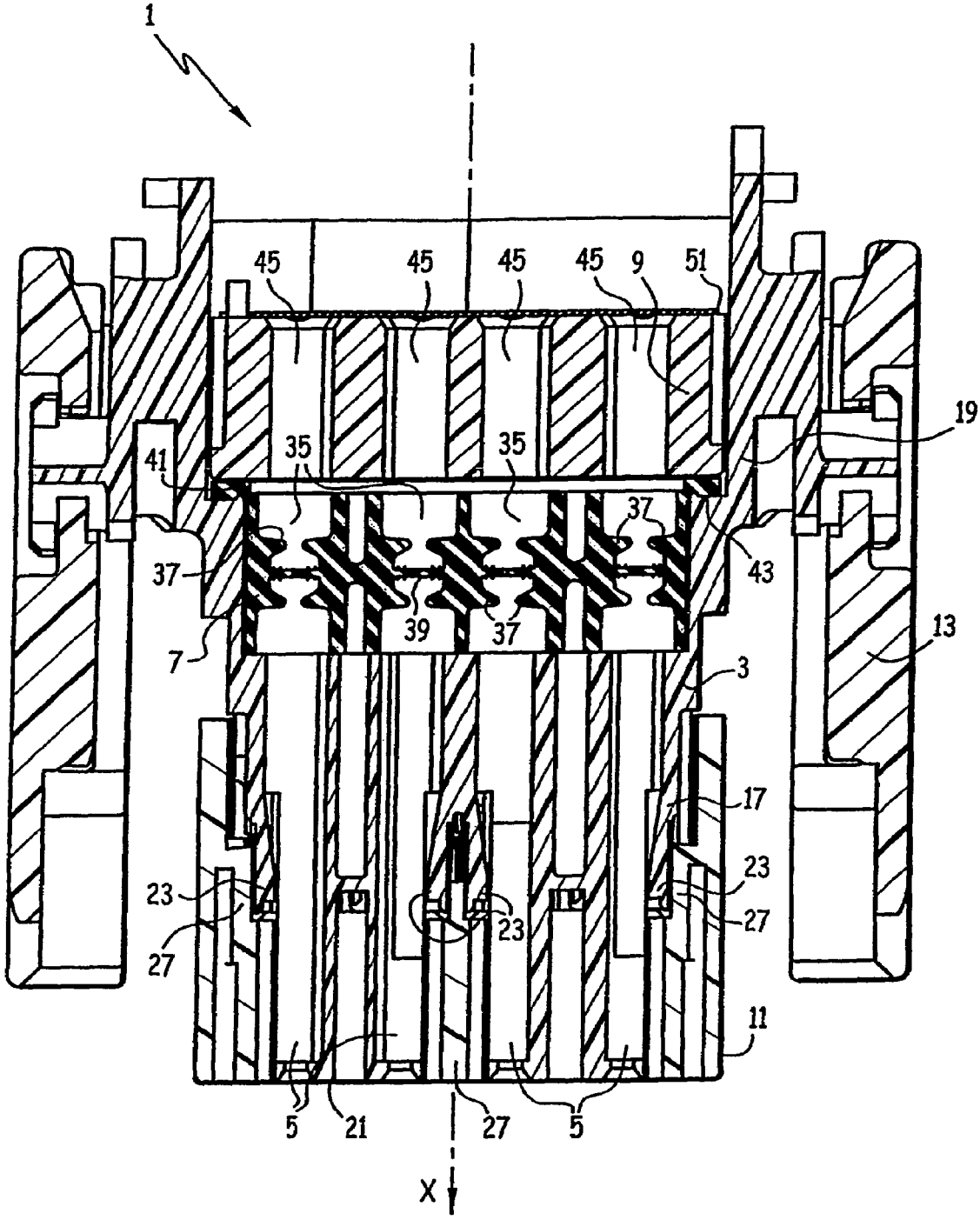
FIG. 2 is a sectional view, on an enlarged scale in a vertical plane along the direction 2-2, of the connector part depicted in FIG. 1.

As is seen in FIGS. 1 and 2, in particular, the connector part 1 comprises essentially an insulating housing 3 made of plastic, in which are formed a plurality of sockets 5 for receiving a contact, a sealing joint 7, and a cable guiding grid 9.

The connector part 1 comprises, in addition, a member (or "key") 11 for secondary locking of the contacts in the housing 3 and a member 13 for locking of the connector part 1 on its matching connector part. This member 13 for locking consists here of a pivoting stirrup that is mounted on the housing 3.

The housing 3 is formed essentially of a front parallelepiped-shaped block 17, which is pierced by axial passages that define the sockets 5, and a rear casing 19, in which the rear end of sockets 5 opens. The front block 17 has a front end face 21, which defines the face that couples with the matching connector part.

Formed in the walls of the front block 17, which delimit the sockets 5, are spring clips 23 for retaining the contacts in their respective sockets.

The secondary locking key 11 is formed as a cover, which, in its active position, is fitted at the front to the peripheral walls of the front block 17. It comprises digits 27 that project toward the rear from its front wall, these digits 27 constituting, in their active position, wedges that block the release of the clips 23. The key 11 and the front block 17 are provided with a means of complementary locking (not visible in the figures), which assures that the key 11 is maintained in its active position.

In the example depicted, the sealing joint 7, also referred to as a "grommet," consists of an elastomer block of a generally parallelepiped outer shape, provided with through-passages 35 that extend from a rear face to a front face and which correspond to the sockets 5. In other words, the passages 35 are aligned with the passages that define the sockets 5. These passages 35 are designed to allow the insertion, from the rear of the housing 3, of the wired contacts into their respective socket 5 and to ensure the sealing of each socket 5 of the rear end of the connector part in cooperation with the insulating sheath of the cable.

For purposes of clarity, neither the contacts, nor the cables have been depicted in FIG. 2.

In order to ensure the rear sealing around the cables, the joint 7 is provided, in each passage 35, with annular lips 37, which form a constriction. In the example depicted, each passage 35 has two annular lips 37, which are axially offset.

In the example depicted, each of the passages 35, prior to wiring of the connector part 1, that is, prior to placing of the contacts in the sockets 5, is blocked by a membrane 39 of one piece and of the same material with the interior walls of the joint 7. The membranes 39 all extend at the same axial level, between the two lips 37 of the respective passage 5. In order for a contact to be placed in a socket 5, the corresponding membrane 39 can be pierced, thereby allowing the passage of the contact, as will be seen later, or else the piercing is performed directly by insertion of the contact.

The joint 7 is engaged in the interior of the casing 19, its front face fitting against the rear face of the front block 17. The peripheral faces of the joint 7 themselves are applied against the inner faces of the casing 19, ensuring a sealing connection.

It will be noted that the joint 7 is formed, in the rear, with a flange 41 that rests on a corresponding peripheral shoulder 43 of the casing 19.

The grid 9 is composed of a piece of plastic of a generally parallelepiped outer shape, formed with passages 45 corresponding to the passages 35 formed in the joint 7. These passages 45 of the grid 9 extend in a through manner from the rear face up to the front face of the grid 9.

Figure 3:
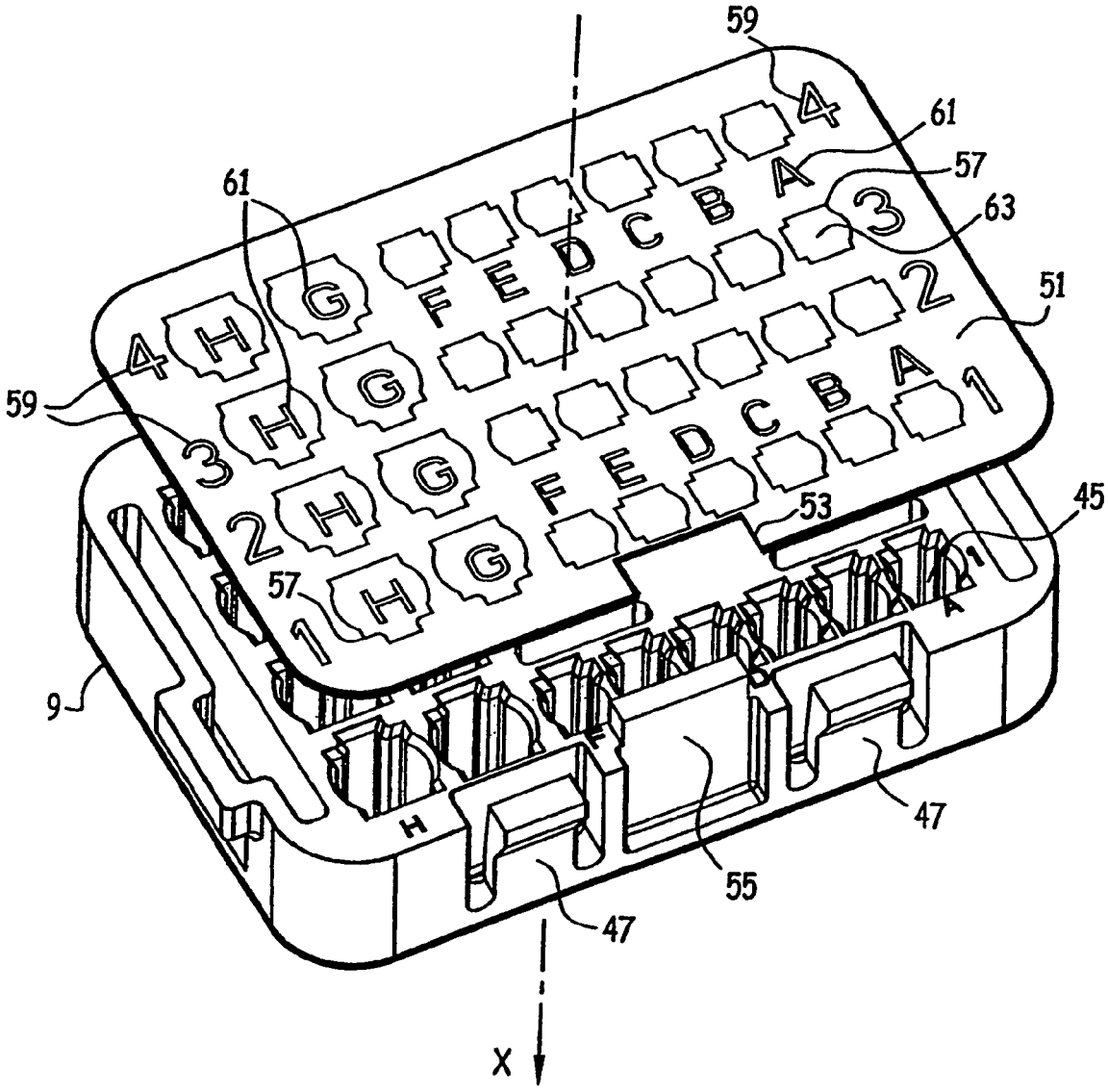
FIG. 3 is a rear perspective view, on an enlarged scale, of the grid and of the blocking member of the connector part of FIG. 1 in an unassembled configuration.

As is seen in FIG. 3, the grid 9 is provided with hooking means 47, in the form of spring arms furnished with hooks, which define the means of fixation of the grid 9 in the casing 19 by spring coupling. Such arms 47 are provided on two opposite peripheral faces of the grid 9. Only two arms of the same face are visible in FIG. 3.

In reference once again to FIG. 2, the grid 9 engages in a form-fitting manner in the casing 19 at the rear of the joint 7 and ensures, when it is fixed in the casing 19, that the joint 7 is maintained in position in the interior of the housing 3 as well as a slight axial compression of the joint.

The grid 9 not only has the function of maintaining and of compressing the joint 7, but it also has the function of maintaining the sections of cable that extend at the entry of the passages 35 in an essentially axial orientation. Such a guiding of the cables is intended to prevent a loss of sealing of the joint, which would be due to a deformation of the joint at the entry of the passages 35 owing to a bending of the cables. This function of the grid 9 is all the more important in that, for a connector part of the type depicted, the bundle of cables at the rear of the connector part 1 is designed to have an orientation that is perpendicular to the X axis.

In general, the connector part 1 comprises a cover, which is not depicted in the figures, fixed behind the housing 3, which ensures the guiding of the bundle of cables as well as the closure of the rear face of the housing after wiring.

In the configuration assembled prior to the insertion of the contacts into the respective sockets 5, the configuration such as depicted in FIGS. 1 and 2, the passages 35 of the joint 7 and the passages 45 of the grid 9 are aligned axially with the respective formed passages of the sockets 5.

As is visible in FIGS. 1 to 3, the connector part 1 comprises, in addition, a blocking member 51, which is fixed on the rear face of the grid 9 and which blocks the passages 45 of the grid 9 at their entry. In the example depicted, the blocking member 51 is composed of a plastic film that covers the rear face of the grid so as to block all of the passages 45. This film is, for example, fastened adhesively or else bonded onto the grid 9.

On one of its edges, the plastic film 51 contains a notch 53, which permits a precise positioning on the grid by way of cooperation of said notch 53 with a reference peg 55 projecting from the grid 9 toward the rear.

As can be noted particularly in FIG. 1, the rear face of the film 51 is visible from the rear of the connector part 1 prior to wiring of the latter. This visible face of the film 51 has markings that allow the position of the entry of each passage 45 to be located and each of these passages to be identified. In particular, the position of a passage is indicated by an outlined marking 57 and the identification of the passage, that is, of the corresponding socket 5, is made possible by a line index 59 and a column index 61. It is obvious that this marking system, which indicates the position and the identity of a socket 5, is suitable for a particular arrangement of lines and columns of the sockets, which is the most common arrangement, and that a different marking system could be provided for in accordance with the arrangement of the sockets.

The blocking member 51 is designed to be pierced prior to wiring of the connector part 1. The piercing is designed to be performed exclusively at the site of the passages 45 corresponding to the sockets 5 in which a contact should be inserted.

According to one variant, which has not been depicted, the blocking member 51 can be composed, on the one hand, of a rigid plate provided with openings corresponding to the entries of the passages 45, that is, corresponding to the sockets 5 and, on the other hand, of closures blocking each of these openings. These closures are designed to be pierced prior to wiring of the connector part 1.

The plate can be fixed in a sealing manner on the rear face of the grid 9, for example, by adhesive fastening or bonding. Alternatively, the plate can be fixed on the grid 9 by spring coupling.

The closures can be formed of a plastic film that covers the rear face of the plate. The film can be marked in the same way as described above in order to locate the position of each of the sockets.

In another embodiment, the blocking member is a thin plastic plate that covers at least partially one face of the grid and is fixed on the grid by spring coupling.

Whatever the embodiment of the blocking member 51, the latter makes use of closures (delimited by the outlines 57) that are appropriate for blocking some of the connection paths in a temporary manner and for blocking other connection paths of the connector part 1, this blocking being in accordance with needs of temporary character or of definitive character.

To do this, the closures 63 are made of a sheet material that can be pierced by means of an adapted tool, as will be seen below. In addition, the closures 63 are designed to support a local piercing, performed selectively and by use of an adapted tool, without any influence on the state of adjacent closures.

The blocking member 51 and, more specifically, the entirety of closures 63, is provided in such a manner that it prevents the insertion of a contact into a specific passage in the absence of a prior piercing of the corresponding closure 63 by the tool intended for this purpose. In particular, the sheet material that constitutes the closures and its thickness are to be chosen in such a way that they prevent the forced manual insertion of the contact through the closure. To do this, the material and its thickness are chosen to resist, without tearing (or breaking), an insertion force of the contact that can be imposed manually by an operator. The blocking member 51 is dimensioned to withstand an applied force of the contact that is appreciably greater than the force of insertion of the contact into the socket of the housing.

Figure 4:
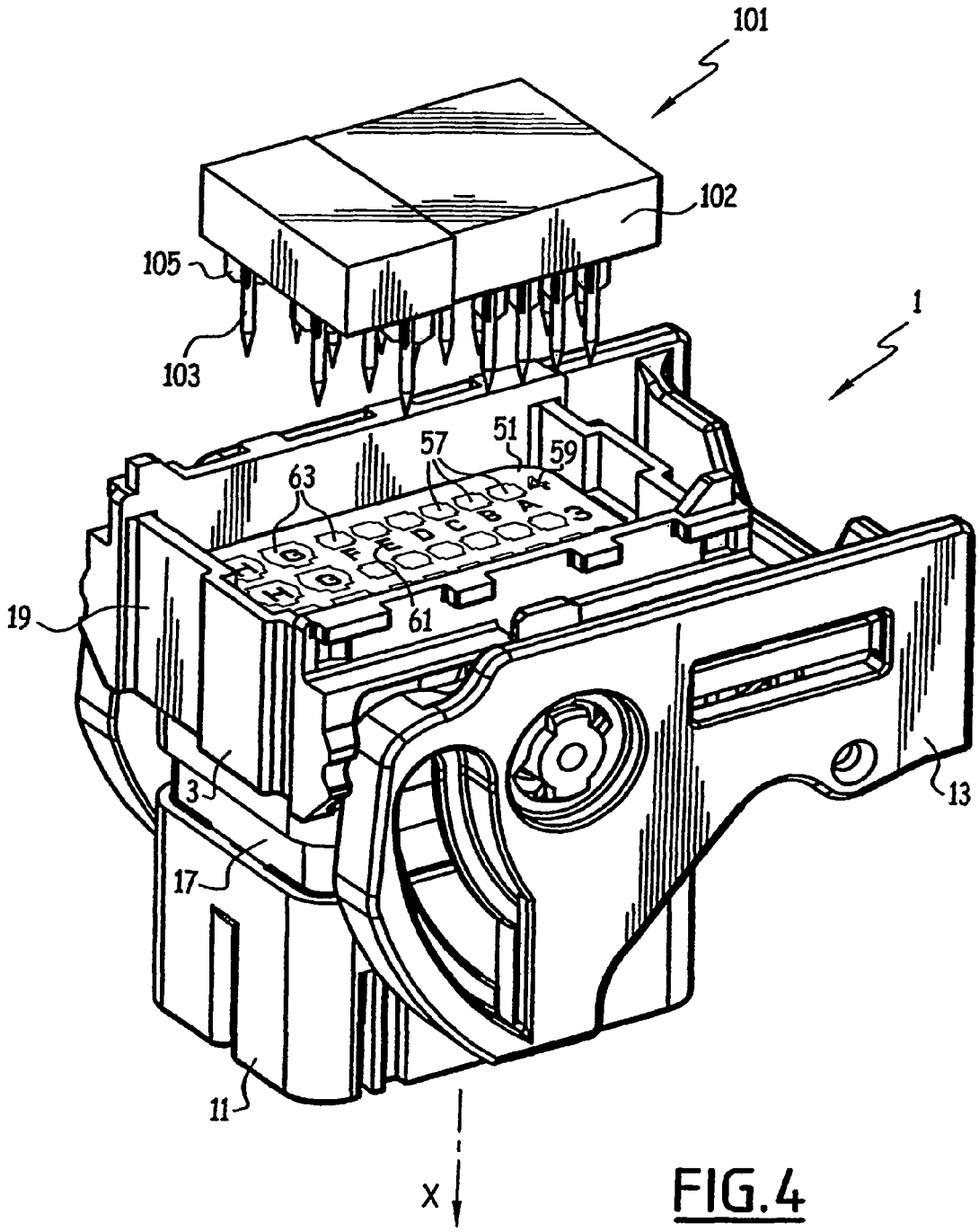
FIG. 4 is a rear perspective view of the connector part of FIG. 1, and of a piercing tool in accordance with the invention, in a standby position behind the connector part.
Figure 5:
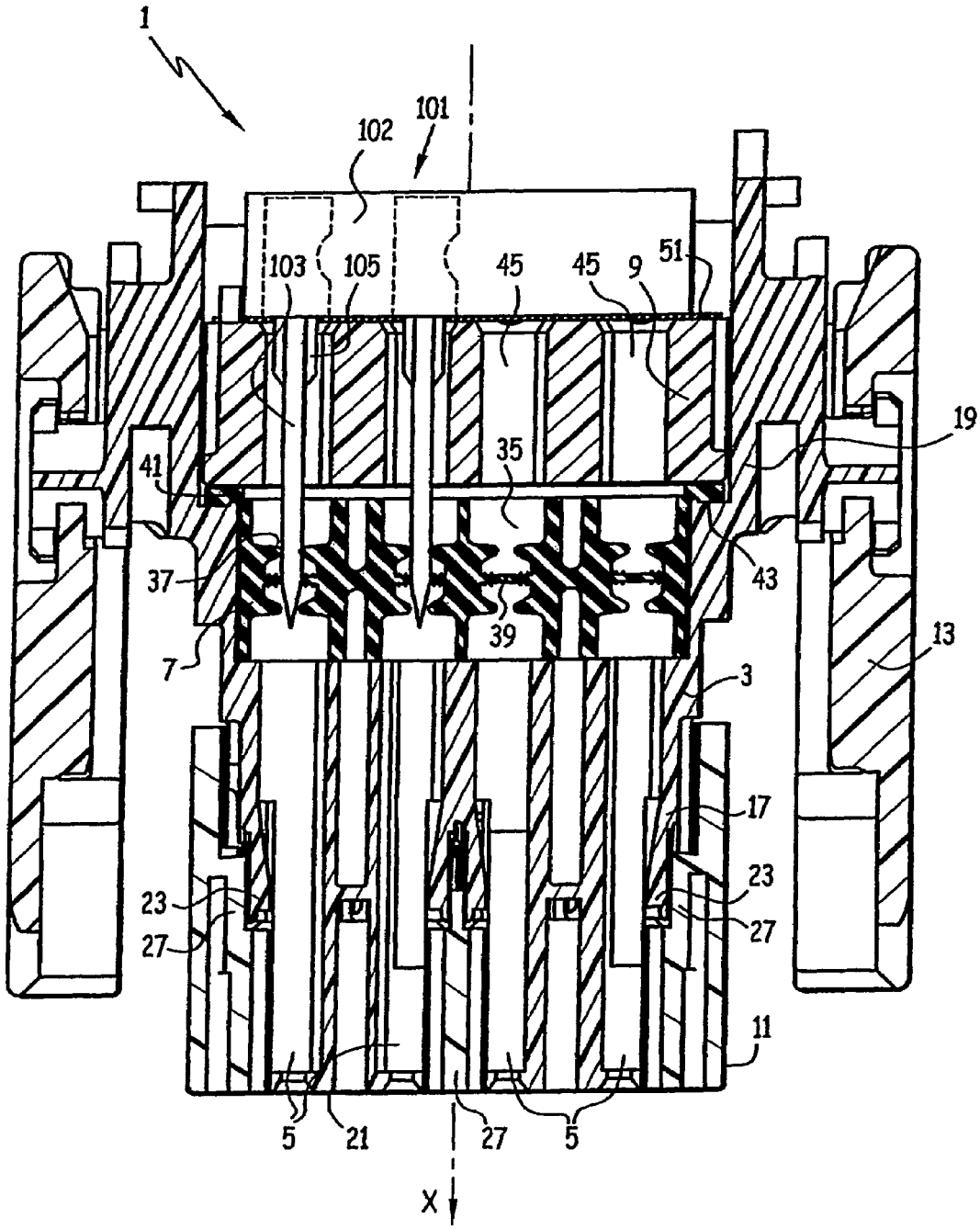
FIG. 5 is a sectional view in the plane of FIG. 2 of the connector part and of the tool, the latter being in the active piercing position.

To be described now, in reference to FIGS. 4 and 5, is a tool that makes it possible to perform the piercing of the blocking member at predetermined sites, corresponding to a group of preselected sockets 5.

The tool 101 that has been depicted in FIGS. 4 and 5 consists essentially of a body 102 and a plurality of pins or points 103, which project from said body in a parallel manner and in the same direction. The tool 101 is designed for a given wiring configuration, in which each socket of a predetermined group of sockets 5 should be occupied by a contact of the corresponding type. Thus, the tool 101 comprises points 103, the number and arrangement of which correspond to the predetermined wiring configuration.

The tool 101 comprises, at the base of each pin 103, radial winglets 105, which are arranged in a starlike manner. These winglets 105 thus form, around the pin 103, four cutting blades designed for performing a piercing of the closure 63 in the form of a cross.

The body 102 has a shape that is adapted for being inserted at least partially into the casing 19 in a form-fitting manner up to a stop position, of engagement, which is defined for example, by the flush alignment of the body 102 on the rear face of the grid 9 or of the blocking member 51.

As seen in FIG. 5, which illustrates the operation of selective piercing of the blocking member 51 and of the membranes 39 formed in the joint 7, the length of the pins 103 is designed such that the full insertion of the tool 101 into the housing 3 accomplishes successively the selective piercing of the closures 63 and of the membranes 39 corresponding to the predetermined group of sockets 5.

Figure 6:
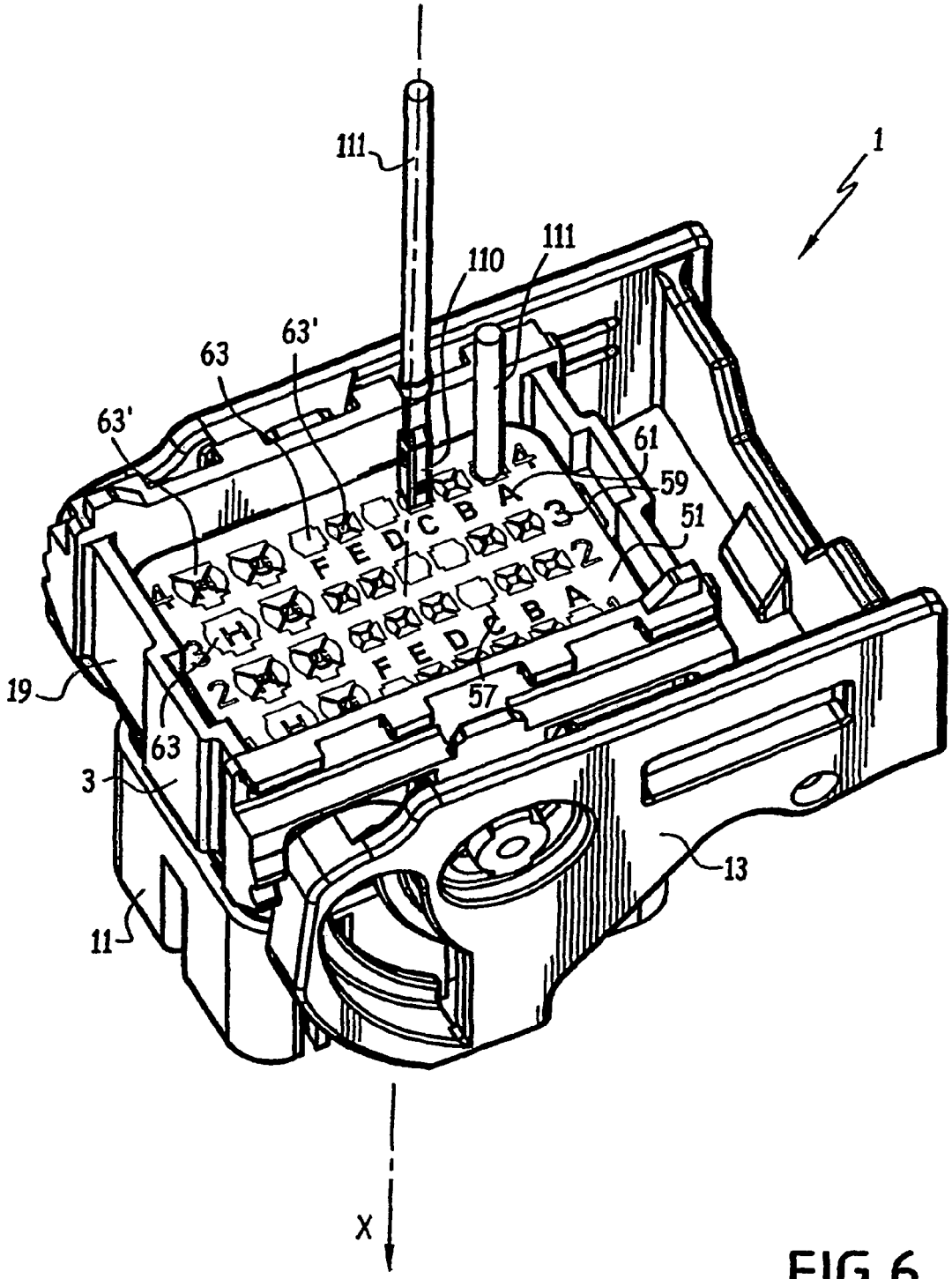
FIG. 6 is a view analogous to FIG. 1 after piercing of the blocking member, the connector part undergoing wiring.

After withdrawal of the piercing tool 101, the access passages 35, 45 to the sockets 5 of the predetermined group are free and it is possible to insert the wired contacts into these sockets, as depicted in FIG. 6.

In this FIG. 6, the closures of the blocking member 51 are depicted either in a pierced (or cut-out form) and thus under the numerical reference 63', or in their intact form and thus under the numerical reference 63.

The pierced closures 63' have elsewhere been depicted with a cross (x) symbol, which illustrates the shape of the piercing due to the winglets 105 at the base of the pins 103.

FIG. 6 illustrates, in addition, the fact that, after selective piercing of the blocking member 51 and of the membranes 39, the insertion of the contacts into each of the corresponding sockets can be carried out. In this figure, a single contact 110 in the course of insertion is visible, this contact being, in the example depicted, crimped to the end of an electrical cable 111.

Also depicted is the cable 111 of a contact that is already placed in its socket.

The wiring operation of the connector part 1, which consists of inserting the wired contacts 110 beforehand into the corresponding sockets, may be performed manually or automatically.

It will be noted in the view of FIG. 6 that it is relatively easy for an operator observing the connector part 1 from the rear to note which of the closures 63, 63' are intact and which are pierced. Owing to the markings present on the rear face of the blocking member 51, it is also easy to identify the sockets that are freely accessible for wiring, subsequent to the piercing operation, and to locate their position.

Thus, the blocking member 51, for which the state of the closures 63, 63' is left apparent, affords a visual indication during the wiring operation. The operator may thus, for example, perceive that a connector part 1 is incompletely wired—that is, it lacks at least contact in one socket, even though the latter is freely accessible.

Because the resistance of the blocking member is provided in such a manner that its piercing is possible only with the aid of the tool (and not by means of a simple contact so that one could attempt to insert it manually), the conformity of an entire series of connectors having the same wiring configuration is ensured, since the piercing tool is correctly configured and tested on a test connector.

In the event of a mistake in the configuration of the piercing tool 101 used, it is also possible for an operator to ascertain visually that a closure 63 has been pierced, even though it ought to have remained intact, the corresponding path having to remain unoccupied. An operator may then remedy this mistake by re-blocking the paths freed by mistake.

Figure 7:
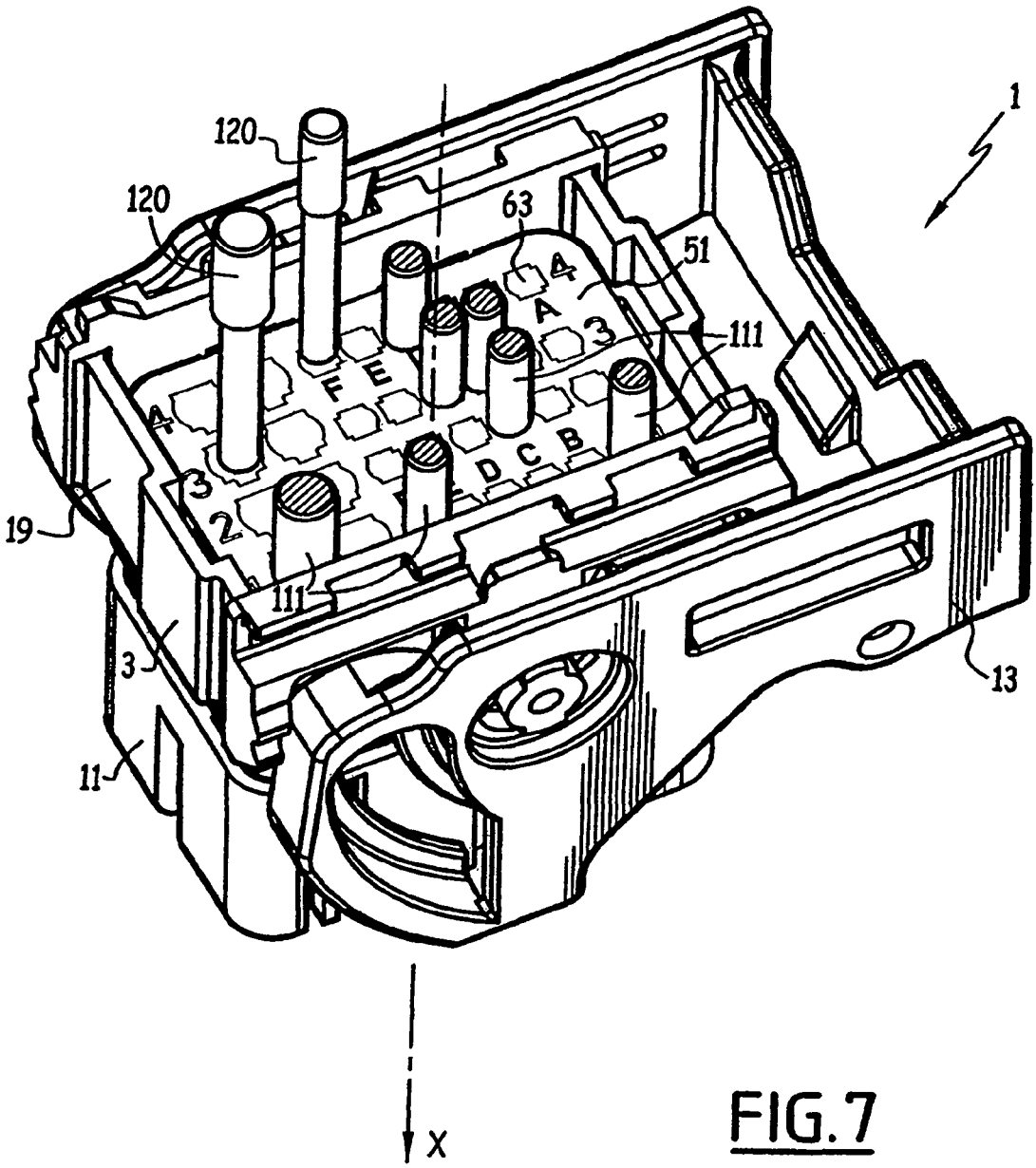
FIG. 7 is a view analogous to FIG. 1 after wiring of some of the connection paths and blocking of some freed paths by mistake.

This situation has been illustrated in FIG. 7, in which are depicted several cable sections 111, linked to contacts which are placed in the respective sockets 5, which belong to the predetermined group of sockets to be wired. Also depicted are two plugs 120, inserted into the respective sockets, the access paths of which have been freed by mistake in the course of the selective piercing operation of the blocking member 51. These plugs 120 have outer shapes that partially reproduce those of a contact and of an end section of the cable. By way of cooperation with the joint 7 and, in particular, with the lips 37 of the respective passage 35, these plugs 120 re-establish the sealing of the paths freed by mistake.

The invention claimed is:

1. An electrical connector part designed for being coupled with a matching connector part by a front face, said connector part comprising an insulating housing provided with a plurality of sockets for receiving a contact, which have a rear contact insertion end, a sealing joint, which is provided with a plurality of cable passages corresponding to the sockets and which is placed in said housing behind the sockets, and a grid for guiding the cables, which is fixed in the housing behind the sealing joint, wherein said grid supports the joint, said grid being provided with a plurality of cable passages corresponding to the sockets, wherein the connector part comprises a blocking member of the passages of the grid, which is fixed on said grid, and is designed to be pierced selectively for inserting the contacts into a group of predetermined sockets, wherein said blocking member is adapted for preventing the insertion of a contact into a given passage in the absence of a prior piercing of the blocking member into said given passage by a tool.

2. The electrical connector part according to claim 1, further characterized in that said blocking member is a plastic film covering at least partially one face of the grid.

3. The electrical connector part according to claim 2, further characterized in that the film is fastened adhesively or bonded on the grid.

4. The electrical connector part according to claim 1, further characterized in that said blocking member comprises a plate that is fixed on the grid.

5. The electrical connector part according to claim 1, further characterized in that said blocking member is fixed on a rear face of the grid.

6. The electrical connector part according to claim 5, further characterized in that said blocking member has, on the rear face, markings for identifying the sockets.

7. An assembly comprising a connector part and a tool for piercing a blocking member of the connector part, wherein the connector part is designed for being coupled with a matching connector part by a front face, said connector part comprising:

an insulating housing provided with a plurality of sockets for receiving a contact, which have a rear contact insertion end, a sealing joint, which is provided with a plurality of cable passages corresponding to the sockets and which is placed in said housing behind the sockets, and a grid for guiding the cables, which is fixed in the housing behind the sealing joint, wherein said grid supports the joint, said grid being provided with a plurality of cable passages corresponding to the sockets, wherein the connector part comprises a blocking member of the passages of the grid, which is fixed on said grid, and is designed to be pierced selectively for inserting the contacts into a group of predetermined sockets, said tool comprising a body and a plurality of pins, which project from said body in a parallel manner and in a same direction and which are designed to pierce the blocking member at points corresponding to a predetermined group of the sockets.

8. The assembly according to claim 7, further characterized in that the pins are tapered at free ends of the pins.

9. The assembly according to claim 7, further characterized in that the body is designed to be engaged at least partially in a form-fitting manner from the rear in an interior of the housing.

10. A method of wiring an electrical connector part according to claim 1, in which the following steps are carried out in succession:

piercing the blocking member by means of a tool in accordance with claim 7, and introducing into each socket, the access of which has been freed by the piercing operation, a wired contact designed for this purpose.

* * * * *